United States Patent [19]

Wilson

[11] 4,299,041

[45] Nov. 10, 1981

[54] ANIMATED DEVICE

[76] Inventor: Stephen H. Wilson, 2008 N. Seminary, Chicago, Ill. 60614

[21] Appl. No.: 77,334

[22] Filed: Sep. 20, 1979

[51] Int. Cl.[3] ..... G09F 1/00; G09F 13/00

[52] U.S. Cl. ..... 40/124.1; 40/442; 40/465; 40/486; 40/902; 40/906; 362/98

[58] Field of Search ..... 40/124.1, 427, 442, 40/459, 460, 463, 465, 464, 486, 541, 553, 152.2, 902, 906; 35/9 D, 35 D; 362/98, 99, 800, 802, 806, 812; 340/712, 365 P; 434/327, 332, 335, 337, 338, 339

[56] References Cited

U.S. PATENT DOCUMENTS

| | | | |
|---|---|---|---|
| 1,490,295 | 4/1924 | Stephens | 40/124.1 X |
| 2,607,145 | 8/1952 | Pope | 362/812 X |
| 2,826,844 | 3/1958 | Leika | 40/902 X |
| 3,015,895 | 1/1962 | Stall | 35/9 D |
| 3,517,937 | 6/1970 | Glass et al. | 40/152.2 X |
| 3,562,922 | 2/1971 | Friedman et al. | 35/9 D |
| 3,588,491 | 6/1971 | Franc | 362/200 |
| 3,621,268 | 11/1971 | Neckarhausen et al. | 340/365 P X |
| 3,622,771 | 11/1971 | Franc | 362/810 X |
| 3,699,668 | 10/1972 | Tesar | 35/9 D |
| 3,740,543 | 6/1973 | Franc | 46/35 |
| 3,761,913 | 9/1973 | Williams | 40/463 X |
| 3,795,063 | 3/1974 | Nelson | 35/9 D X |
| 3,798,806 | 3/1974 | Sanford | 40/124.1 |
| 4,055,014 | 10/1977 | Schmidt et al. | 40/457 X |
| 4,102,067 | 7/1978 | Tarrant | 40/455 |
| 4,107,462 | 8/1978 | Asija | 40/457 X |
| 4,169,970 | 10/1979 | Opiela et al. | 40/455 X |
| 4,195,431 | 4/1980 | Neufeld | 40/152.2 X |
| 4,209,824 | 6/1980 | Kaufman | 362/98 |

*Primary Examiner*—Gene Mancene
*Assistant Examiner*—G. Lee Skillington
*Attorney, Agent, or Firm*—David D. Kaufman

[57] ABSTRACT

A device in the form of a greeting card, display card, or the like, for producing a visual and/or a sound effect which includes a panel member or the like onto which is applied pictorial and/or printed matter in association with an effects generator, an electronic circuit mounted on the panel member but not visible to the reader of the matter but to which the effects generator is connected, and an activator on the panel member which, when actuated, causes triggering of the electronic circuit to energize the effects generator.

5 Claims, 9 Drawing Figures

ANIMATED DEVICE

This invention relates in general to an animated device for producing a special effect to the user or recipient, thereby enhancing the enjoyment and/or education of the reader or recipient.

The animated device of the present invention is particularly useful as applied to greeting cards, advertising-promotional display literature, books and particularly one or more pages of a book, business cards, invitations to events, and reminder cards, although it should be appreciated that the invention may be used wherever there is a need or desire to provide an animated message. It may be further appreciated that the animation would be provided in relation to pictorial and/or word matter by an effects generator which produces light and/or sound and/or movement of parts. Similarly, an activator is provided in one or more forms which may be responsive to light, sound, temperature, internal timers, attitude or position of the device or touch, such as an electrical conductive path being produced between two contacts which is connected to an electronic circuit into which the effects generator is connected, and which will trigger the electronic circuit in order to cause energization of the effects generator. In this respect, the greeting card includes means for triggering the electronic circuit to drive the effects generator and produce animation for the pictorial and/or word matter, wherein that means would be operable by the person receiving the card and integrated with the pictorial and/or word matter. Further, the device may be made into two parts which, when joined together, will close the electronic circuit and cause the effects generator positioned on one or both of the parts to be energized. The usefulness of the present invention in connection with providing animation to pictorial and/or word matter is unlimited especially in view of the relatively inexpensive components needed to produce the animation.

Heretofore, it has been known to provide illuminated greeting cards, such as illustrated in U.S. Pat. Nos. 2,607,145 and 2,826,844, both of which merely utilize straightforward electrical circuits and which merely provide limited effects through illumination. Similarly, it has been known otherwise to provide illuminated greeting cards, such as illustrated in U.S. Pat. Nos. 3,522,426, 3,588,491 and 3,740,543. It has also been known to provide a book with an illuminated rear page as illustrated in U.S. Pat. No. 3,622,771. The greeting cards heretofore known as illustrated by these patents have not had the capability of being uniquely activated and have been incapable of providing unique effects.

It is therefore an object of the present invention to provide a new and improved animated device which includes an effects generator associated with pictorial and/or word matter applied to a panel member or the like and which also includes an activator associated with the pictorial and/or word matter which, when operated, triggers an electronic circuit in which the effects generator is included for energizing the effects generator and producing animation to the pictorial and/or word matter.

Other objects, features and advantages of the invention will be apparent from the following detailed disclosure, taken in conjunction with the accompanying sheets of drawings, wherein like reference numerals refer to like parts, in which.

Figure 1:
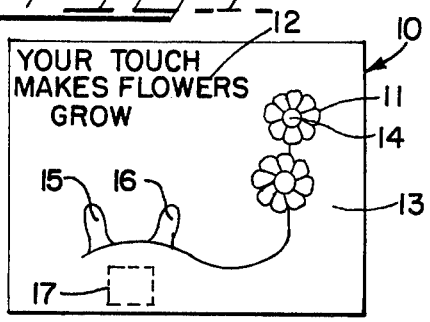
FIG. 1 is a front elevational view of a greeting card illustrating one embodiment of the invention.
Figure 2:
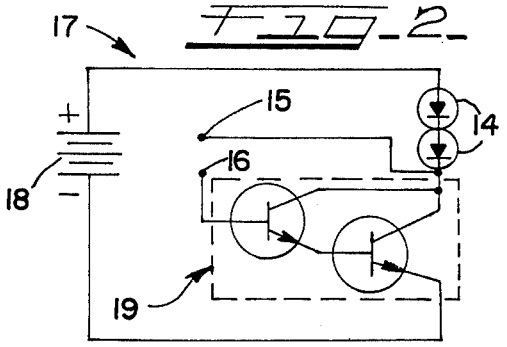
FIG. 2 is a schematic electrical diagram of the circuit including the effects generator and activator associated with the greeting card of FIG. 1.

The present invention, as illustrated in the embodiment of FIGS. 1 and 2, is in the form of a greeting card 10 having pictorial matter 11 and word matter 12 suitably applied such as by printing onto a panel member 13. Light emitting diodes 14 (LEDs) are positioned centrally of flower blossoms pictorially illustrated in the pictorial matter 11 which illuminate upon providing a conductive path between contacts 15 and 16 arranged along the stem of the pictorial flowers, thereby animating the card. The contacts 15 and 16 are of a suitable conductive material and interconnected into an electronic solid state circuit. Similarly, the LEDs 14 are connected into the same electronic solid state circuit which are mounted on the panel member but not visible. For example, the circuit is illustrated in block form and phantom by the numeral 17.

The circuit 17 is shown schematically in FIG. 2 which includes a battery 18 connected on one side to the LEDs 14 which are connected in series and on the other side to an NPN Darlington transistor network 19, which is connected in series with the LEDs 14. One of the contacts, such as illustrated by the number 15, is connected between the Darlington network 19 and the LEDs, while the other contact 16 is taken from the Darlington network. Application of a conductive path between contacts 15 and 16, such as by the touch of a person, for example, where two fingers of a person are applied to each of the contacts 15 and 16, will trigger the power Darlington transistor network 19 to make the path between the LEDs and the battery on the one side conductive so that the battery will power the LEDs and cause them to illuminate. Illumination of the LEDs causes animation of the greeting card. It can be appreciated here that the LEDs used in the circuit constitute the effects generator of the device, while the electrically conductive contacts 15 and 16 constitute the activator for the device. As will be clear hereinafter, the activator may take any number of forms as can the effects generator.

Figure 3:
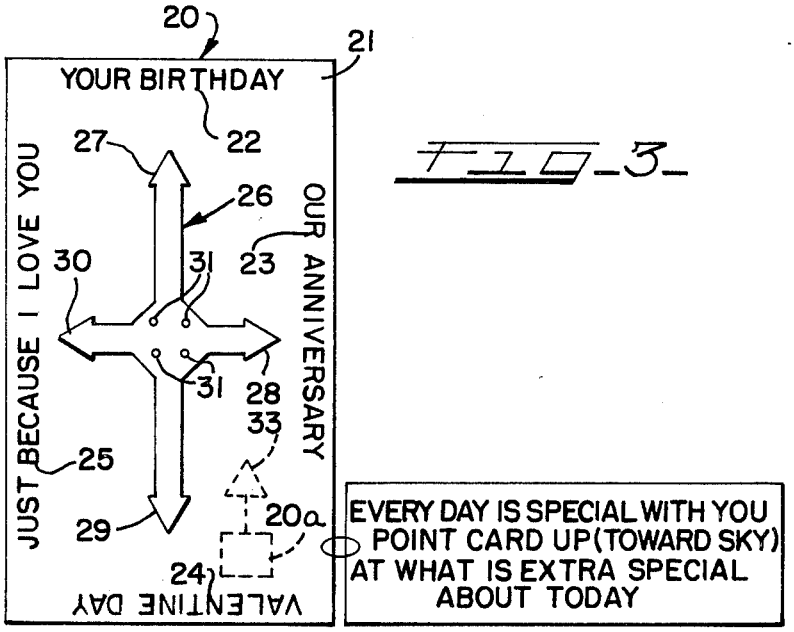
FIG. 3 is a front elevational view of a still further type of greeting card according to the invention to illustrate the additional types of activators and/or effects generators that may be employed.
Figure 4:
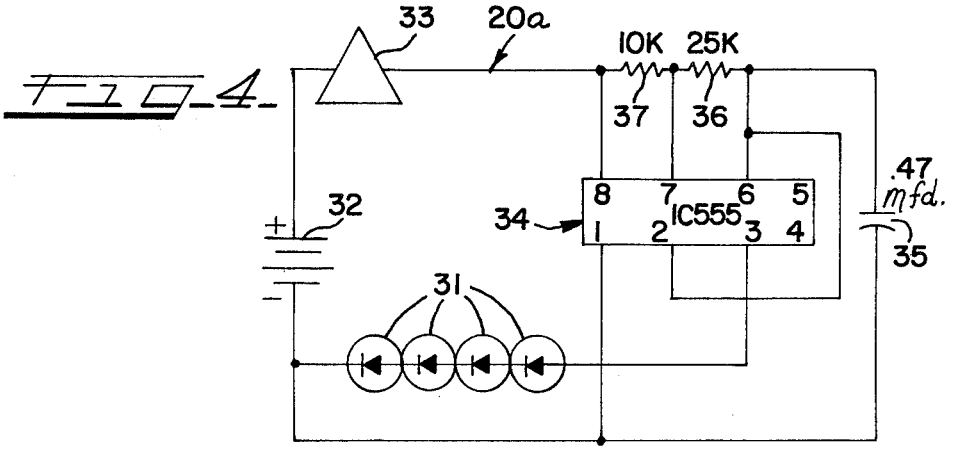
FIG. 4 is an electrical schematic diagram of the circuit including the effects generator and the activator utilized for the animated device of FIG. 3.

The embodiment of FIGS. 3 and 4 is in the form of the greeting card 20 suitable for providing an animated greeting for a plurality of special events or special days. This greeting card includes a panel member 21 having word matter in the form of phrases designated by 22, 23, 24 and 25 arranged on the four edges of the panel member, each of which designates a different day or event as noted. Arranged centrally of the panel member is pictorial matter 26 having four arrow configurations, one pointed toward each of the word phrases and identified by the numerals 27, 28, 29 and 30. Within the central part of the pictorial matter 26, a plurality of LEDs 31 are positioned to provide at selected times animation of the card. This card is designed to satisfy any of a plurality of special days upon being suitably adjusted, as hereinafter described.

The electronic circuitry 20A for the greeting card 20 is illustrated in FIG. 4 and includes a battery 32 connected at one end to a mercury position switch 33 and at the other end to series connected LEDs 31 together with one terminal of an integrated circuit 34 and a capacitor 35. The capacitor is also connected in series to resistors 36 and 37 which are respectively connected across terminals 6 and 7 and 7 and 8 of the integrated circuit 34. The LEDs are also connected to terminal 3 of the integrated circuit, while terminals 6 and 2 are shunted.

Once again, the electronic circuit illustrated in FIG. 4 would not be visible from the front of the card 20. While this card is illustrated as having four events identified by word phrases and four arrows, it can be appreciated that it can have any number of word phrases and any number of arrows corresponding to a respective member of positions or indicators, depending upon the design of the card.

In operation, the mercury switch 33, which is a positional switch, is set on the back of the card to a position for operating the electronic circuit when the card is oriented in a certain direction and in a direction toward the event or day desired to be recognized. For using the birthday word phrase 22, the mercury switch 33, as illustrated in phantom on the panel member 21, would be positioned in the direction so that when the card is in the upright direction, as illustrated in FIG. 3, the circuit 20A will be energized by the closing of the mercury switch 33 to cause operation of the timer chip 34 and the triggering of the LEDs 31. With the LEDs 31 energized, animation is applied to the panel member 21 in connection with the proper positioning of the card to the special birthday event. Likewise, when the mercury switch 33 is oriented to the "anniversary," "valentine," "love" word phrases 23, 24 and 25, the card, when positioned so the arrow for the respective word phrase points upward toward the sky, will then cause animation of the card by energization of the LEDs 31.

It can now be appreciated that the effects generator is the light produced by the LEDs when the card is oriented in accordance with the setting of the positional mercury switch 33, while the activator in this embodiment is in the form of the mercury switch 33. As in the first embodiment, a suitable battery may be used, such as a small 9-volt battery of the dry cell type, a wafer battery or the like, and the electronic components in the solid state circuitry are matched so as to be powered by this battery when the circuit 20A is energized. It can be recognized that in this embodiment, the mercury position switch 33 serves as the activator for the animation, while again a set of diodes serves as the effects generator together with the pictorial and word matter on the panel member.

Figure 5:
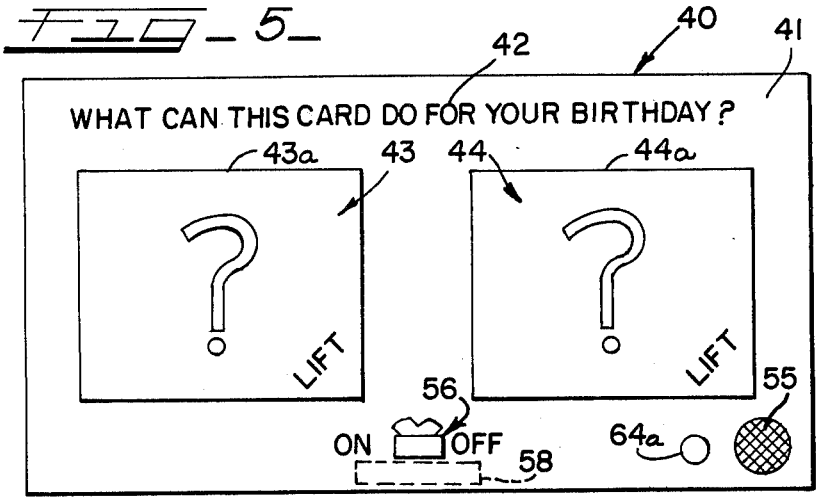
FIG. 5 is a front elevational view of a still further embodiment of the invention.
Figure 6:
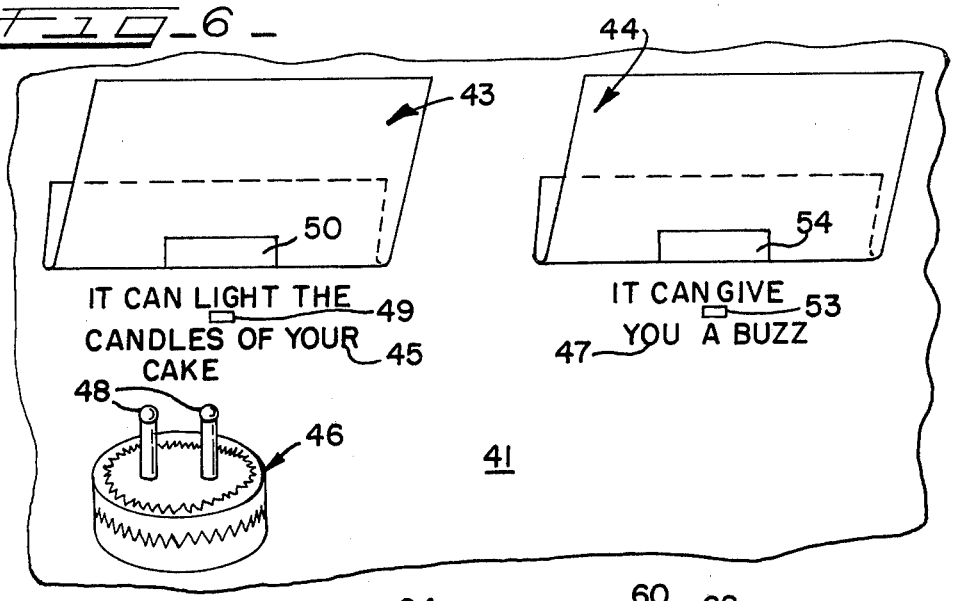
FIG. 6 is a fragmentary view of the embodiment of FIG. 5 and illustrating the raising of flaps to expose portions of pictorial and word matter together with activators for triggering effects generators.
Figure 7:
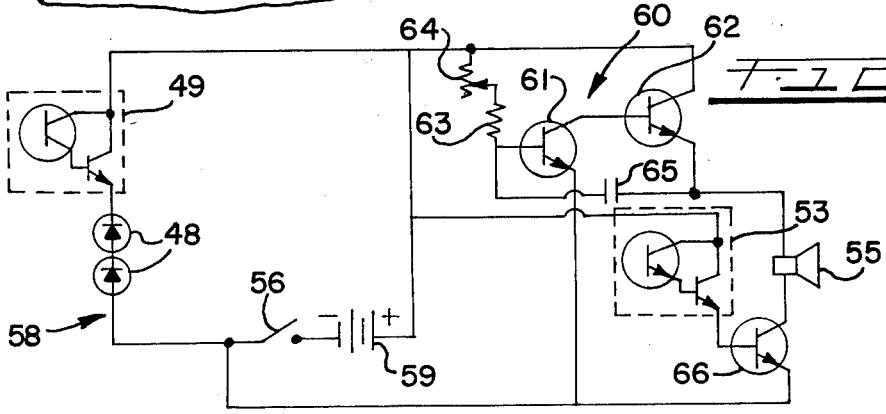
FIG. 7 is an electrical schematic diagram of a solid state electronic circuit utilized with the animated device of FIGS. 5 and 6 and which also include the effects generators and the activators.

The embodiment illustrated in FIGS. 5, 6 and 7 differs somewhat from the other embodiments in illustrating the use of other activators and other effects generators. This embodiment is also in the form of a greeting card and generally designated by the numeral 40. The card includes a panel member 41 onto which is applied a word phrase or word matter 42 across the upper part of the panel member. Below the word phrase, a pair of flap members 43 and 44 are hingedly mounted along their top edges 43*a* and 44*a* to the panel member 41. These flap members have imprinted thereon question marks, together with an instructional phrase at the lower right-hand corner indicating to the user that the flap should be lifted up.

As seen in FIG. 6, below the flap member 43, a word phrase 45, together with a picture 46 of a cake, is imprinted on the panel member. Similarly, a word phrase 47 is provided beneath the flap member 44. At the tip end of the candles on the cake representation 46 a pair of LEDs 48 are mounted which will illuminate upon opening of or lifting of a flap member 43, as will be more clearly understood hereinafter with the description of the electronic circuit for this greeting card. Thus, the LEDs 48 serve as an effects generator, while a light sensitive device 49 arranged within the word phrase 45 will serve as the activator for the electronic circuit. In order to be sure that the light sensing device 49 is not otherwise energized, a light blocking member 50 is provided on the back side of the flap member 43 which aligns with and over the light sensing device 49 when the flap 43 is in the closed position, as shown in FIG. 5. Similarly, the flap member 44 in the open position, as shown in FIG. 6, not only exposes the word phrase 47 but also exposes a photo-sensing device 53. A light blocking member 54 aligns with and over the light sensing device 53 when the flap member 44 is in closed position. Exposure of the light sensing device 53 to light energy causes a sound to be generated in a speaker 55 mounted on the panel member 41. Thus, the effects generator is in the form of a sound which can be heard upon raising of the flap member 44.

An on-off switch 56 may be optionally provided for purposes of overriding the operation of the circuit. When the switch is in the on position, it will be appreciated that raising of the flaps causes the operation of the activators which are in the form of light sensing devices, while when the switch 56 is in the off position, power is disconnected from the circuit in which the light sensing devices and the effects generators are included.

Referring now to FIG. 7, the electronic solid state circuit for this greeting card is generally identified by the numeral 58 and includes a suitable power source such as in the form of a battery 59 connected in series with the portion of the circuit in which the LEDs 48 and the light sensing device 49 are included. Any suitable light sensing device may be employed, such as a photocell, photo-resistor, photo-transistor, or the like.

The portion of the circuit including the light sensing device 53 and the speaker 55 also includes an oscillator 60 having an NPN transistor 61 and a PNP transistor 62. The base of the transistor 61 is connected in series to a load resistor 63 and a variable resistor or potentiometer 64. The collector of the transistor 61 is connected to the base of the transistor 62, while the emitter of the transistor 62 is also connected to the base of the transistor 61 through the potentiometer 64 and load resistor 63. A capacitor 65 is connected across the emitter of transistor 62 and the base of transistor 61. A gating transistor 66 is connected in series with the speaker and the oscillator and power source such that when the transistor 66 is conductive or on, the oscillator will function to cause a sound in the speaker 55. The collector of the transistor 66 is connected to the speaker, while the emitter is connected back to the battery and to the emitter of the oscillator transistor 61. The base of transistor 66 is connected to the light sensitive device 53 which in turn is connected to the battery.

Accordingly, with the switch 56 in closed position, exposure of the light sensing device 53 to light will energize the oscillator circuit and gate the output to the speaker 55, thereby causing a sound in the speaker. The sound will be in the form of a tone or buzz which can be regulated in intensity by adjustment of the potentiometer 64. A knob 64*a* may be provided on the panel member 41 for adjustment of the potentiometer 64. Alternatively, the control for the potentiometer may be positioned at the back of the panel 41. Further, while the speaker 55 is illustrated as being in the lower right-hand corner of the panel 41, it can be located elsewhere on the panel member if desired. For example, it could be located under the flap member 44.

The light sensing devices 49 and 53 illustrated in the circuit 58 are in the form of a photo-Darlington circuit, but they may take any other suitable form.

It may be further appreciated that the greeting card 40 is utilized herein to illustrate the use of two different types of effects generators and a particular greeting card may only include a single flap member together with a desired activator and effects generator.

Figure 8:
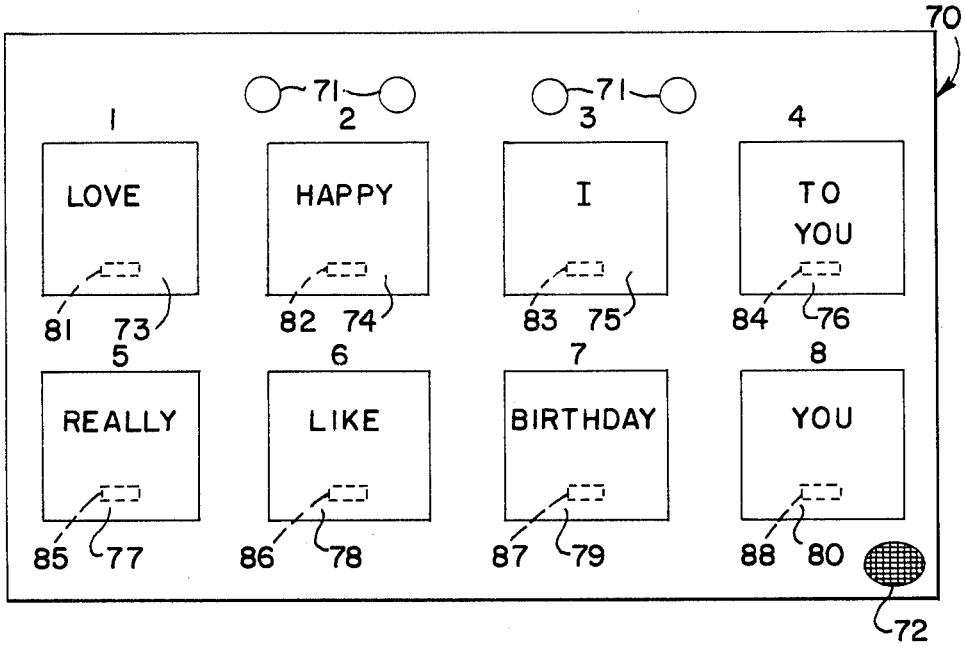
FIG. 8 is a front elevational view of a still further embodiment of the invention utilizing word flaps covering light sensing devices connected into a logic circuit which requires sequential operation to trigger effects generators.
Figure 9:
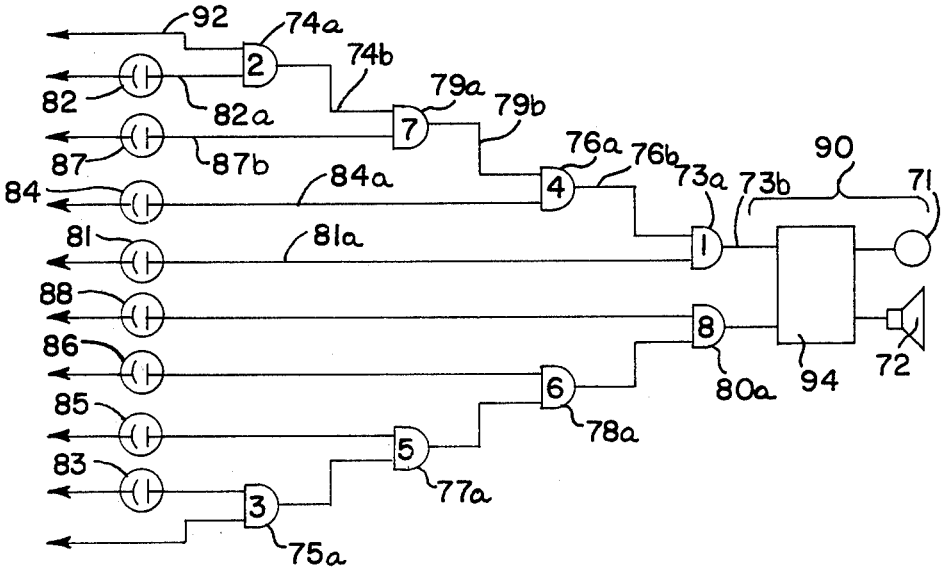
FIG. 9 is a schematic diagram of the logic circuit for the embodiment of FIG. 8.

The embodiment of FIGS. 8 and 9 differs from the other embodiments in that the greeting card, designated by the numeral 70, is provided with an electronic circuit having a logic circuit which must be operated in a particular sequence in order to trigger the effects generator. While any type of effects generator can be provided, the greeting card 70 includes a plurality of lights 71 and a speaker 72 for providing light and sound signals.

Further, the greeting card includes a plurality of word flaps covering light sensitive devices or elements wherein the recipient of the card must sequentially expose the light sensitive elements according to the words that will provide a particular greeting in order to trigger the electronic circuit for in turn triggering the effects generator. An identification of the word flaps and the words on each flap is as follows:

Love—73
Happy—74
I—75
To You—76
Really—77
Like—78
Birthday—79
You—80

Raising the word flaps 73 to 80 exposes respectively the light sensitive devices 81, 82, 83, 84, 85, 86, 87 and 88 thereunder and mounted on the card.

The logic circuit is shown in FIG. 9 into which is connected the light sensitive elements 81 to 88. AND gates are connected with the light sensitive elements and to an effects generator 90 in such a manner that proper sequencing of word flap exposure will give a signal to the effects generator for activating same. In this embodiment it will be appreciated that the activator constitutes the light sensitive devices 81 to 88 in combination with the word flaps 73 to 80, as it is necessary to expose the light sensitive elements to the light before the circuit can be activated. The AND gates of the circuit are identified by the same numerals as the word flaps together with a suffix "a." It will be appreciated that the AND gates require two signals before they are opened. An example of operation of the greeting card would involve the selection of a greeting which would require the user to understand the greeting and to sequentially expose a series of light sensitive devices. For the greeting "happy birthday to you, love," the user would first expose the light sensitive device 82 by raising the flap 74 which would impart a signal to the AND gate 74*a* through line 82*a*. A continual signal would be imparted along line 92 whereby gate 74*a* would be opened to send a signal along line 74*b* to AND gate 79*a*. Thereafter, raising the flap 79 having the word "birthday" would expose the light sensitive device 87 to feed a signal along line 87*b*, to open the gate 79*a* and feed a signal along line 79*b* to AND gate 76*a*. Next the word flap 76 with the words "to you" would be raised to expose the light sensitive device 84, sending a signal along line 84*a* to open the AND gate 76*a* and feed a signal to AND gate 73*a* along line 76*b*. Finally, the greeting would be completed by raising the word flap 73 having the word "love" to expose the light sensitive device 81 and feed a signal along line 81*a* to the AND gate 73*a*, thereby opening the gate and feeding a triggering signal along line 73*b* to the effects generator 90.

In this embodiment the effects generator includes an oscillator 94 controlling the operation of the lights 71 and the speaker 72 so as to impart pulsing signals and cause flashing of the lights and intermittent tones in the speaker 72. It will be appreciated that any type of effects generator may be utilized as previously explained. Further, the light sensing devices may take any desired form such as those previously identified.

The logic circuit may be set up so that any of two messages may be provided to the user or that one of two messages may be provided. In the latter instance, a switching mechanism could be employed for choosing the greeting "happy birthday to you, love" or an alternate greeting "I really like you." It may be appreciated that any other type of greeting may be provided if so desired.

The operation of the logic circuit for the greeting "I really like you" would involve the sequential raising of flaps 75, 77, 78 and 80 to respectively sequentially expose light sensing devices 83, 85, 78 and 88 in a like manner as explained with respect to the logic circuit controlling the message "happy birthday to you, love" so that the effects generator 90 would be triggered to produce the flashing of the lights and intermittent tones. Thus, a plurality of messages could be provided or the greeting card with logic circuitry could be set up so that only a single message is provided. In either event, it would require sequential choosing of words in order to activate the effects generator and obtain the maximum benefit of the greeting card.

It may be further recognized that the activators may take other forms than illustrated in the above described embodiments. For example, an activator may be responsive to ultrasonic energy, infrared light energy, standard radio frequencies, temperature variation, electromagnetic radiation, humidity change, an internal time and/or memory device, logic circuitry, a particular time period or the like. Similarly, it may be appreciated that the effects generator, in addition to being in the form of illumination and sound, could be in the form of a movement or motion action, such as where electromechanical devices would be involved to effect movement of a part. The type of effects generators may be of any desired design and one greeting card or display member could have one or more effects generators for providing a desired animation.

It is also contemplated within the invention to provide a panel member having mating segments where each segment may include thereon pictorial and/or word matter together with an effects generator, whereby joining the segments together in proper mating relation would cause the energization of a circuit and an activation of the effects generator. In this event, the activator would be in the form of a switch to close the circuit, which switch would be closed by the piecing together of the segments in a proper manner.

While the present invention has been illustrated in the drawings and described in association with the use as a greeting card, it will be appreciated that it can be employed for use with other devices as previously identified.

It will be understood that modifications and variations may be effected without departing from the scope of the novel concepts of the present invention, but it is understood that this application is to be limited only by the scope of the appended claims.

The invention is hereby claimed as follows:

1. An animated greeting card comprising a panel member having pictorial and/or word matter on one face, a solid state electronic circuit mounted on said member but not visible from said one face, an effects generator associated with said pictorial and/or word matter and connected into said electronic circuit, said effects generator being used for producing light and/or sound, and means for triggering the electronic circuit to drive the effects generator and produce animation for the pictorial and/or word matter, said means operable by the person receiving the card and integrated with the pictorial and/or word matter, said means including a pair of contact members mounted on said one face and interconnected with said circuit such that engagement of both said contact members by a person closes said circuit.

2. An animated greeting card comprising a panel member having pictorial and/or word matter on one face, a solid state electronic circuit mounted on said member but not visible from said one face, an effects generator associated with said pictorial and/or word matter and connected into said electronic circuit, said effects generator being used for producing light and/or sound, and means for triggering the electronic circuit to drive the effects generator and produce animation for the pictorial and/or word matter, said means operable by the person receiving the card and integrated with the pictorial and/or word matter, said means including a position switch interconnected with said circuit and which responds to a substantial change in position by a person handling the card.

3. An animated greeting card comprising a panel member having pictorial and/or word matter on one face, a solid state electronic circuit mounted on said member but not visible from said one face, an effects generator associated with said pictorial and/or word matter and connected into said electronic circuit, said effects generator being used for producing light and/or sound, and means for triggering the electronic circuit to drive the effects generator and produce animation for the pictorial and/or word matter, said means operable by the person receiving the card and integrated with the pictorial and/or word matter, said means including at least one normally open light sensing switch in said circuit and mounted on said one face, and a light blocking flap hingedly mounted on said one face to normally cover said switch which when raised exposes said switch to light and causes the switch to close.

4. The animated device of claim 3, wherein the electronic circuit includes a logic circuit, and said means includes a plurality of light sensing switches covered by light blocking flaps, wherein a sequential raising of said flaps causes the logic circuit to activate the effects generator.

5. The animated device of claim 1, 2, or 3 wherein the electronic circuit includes means timing the activation of the effects generator.

* * * * *